US011912530B2

(12) United States Patent
Tu

(10) Patent No.: US 11,912,530 B2
(45) Date of Patent: Feb. 27, 2024

(54) WINDING DEVICE WITH SPEED REGULATING MECHANISM

(71) Applicant: Wei Tu, Zhejiang Province (CN)

(72) Inventor: Wei Tu, Zhejiang Province (CN)

(73) Assignee: Wei Tu, Ningbo (CN)

( * ) Notice: Subject to any disclaimer, the term of this patent is extended or adjusted under 35 U.S.C. 154(b) by 160 days.

(21) Appl. No.: 17/582,685

(22) Filed: Jan. 24, 2022

(65) Prior Publication Data

US 2023/0159300 A1 May 25, 2023

(30) Foreign Application Priority Data

Nov. 23, 2021 (CN) ..... 202122882776.9

(51) Int. Cl.
*B65H 75/44* (2006.01)
*B65H 75/40* (2006.01)

(52) U.S. Cl.
CPC ..... *B65H 75/4481* (2013.01); *B65H 75/403* (2013.01); *B65H 2403/484* (2013.01)

(58) Field of Classification Search
None
See application file for complete search history.

(56) References Cited

U.S. PATENT DOCUMENTS 913,980 A * 3/1909 Rhoades ..... 28/175
1,208,372 A * 12/1916 Rettinger ..... B60S 1/18 242/483.1
1,365,413 A * 1/1921 Kochendorfer ..... B65H 63/04 242/485
1,504,005 A * 8/1924 Vienneau ..... B65H 54/2809 242/178
2,104,656 A * 1/1938 Krejci ..... B65H 59/38 242/420.6
2,161,459 A * 6/1939 Demay ..... B65H 54/22 235/132 R
2,301,208 A * 11/1942 Gear ..... B65H 75/4486 242/390.8
2,385,691 A * 9/1945 Corbin ..... B65H 19/2238 242/532.2
2,533,382 A * 12/1950 Lorenz ..... B65H 54/2848 242/482.7
3,232,555 A * 2/1966 Gorrell ..... B65H 75/4407 242/390.8

(Continued)

*Primary Examiner* — William A. Rivera
(74) *Attorney, Agent, or Firm* — TAROLLI, SUNDHEIM, COVELL & TUMMINO L.L.P.

(57) ABSTRACT

The patent discloses a winding device with a speed regulating mechanism. The winding device with a speed regulating mechanism includes a device body and a winding wheel installed on the device body. The speed regulating mechanism is arranged on one side of the winding wheel and includes a transmission gear set and a speed regulating shifting rod. The transmission gear set includes a sliding output gear and a speed regulating transmission member. According to the winding device with a speed regulating mechanism, the speed regulating mechanism is installed in the winding device, through the regulation of the speed regulating shifting rod, the transmission efficiency of a water turbine can be changed, and the regulation of various winding speeds can be achieved. Moreover, an idling function can be fulfilled after an output shaft is pulled through a handle, which makes the winding wheel suspend moving.

9 Claims, 10 Drawing Sheets

(56) References Cited

U.S. PATENT DOCUMENTS

| | | | | |
|---|---|---|---|---|
| 4,369,928 | A * | 1/1983 | Riekkinen | B65H 67/052 242/474.4 |
| 4,513,772 | A * | 4/1985 | Fisher | B65H 75/4407 192/114 R |
| 6,561,449 | B2 * | 5/2003 | Lindermeir | B65H 75/4402 137/355.27 |
| 2003/0213865 | A1 * | 11/2003 | Moon | B65H 75/4471 242/390.8 |
| 2005/0017117 | A1 * | 1/2005 | Moon | B65H 75/4471 242/390.8 |
| 2008/0164361 | A1 * | 7/2008 | Fancher | B65H 75/4442 242/381 |
| 2011/0265888 | A1 * | 11/2011 | Strachan | B65H 75/4407 137/355.2 |

* cited by examiner

WINDING DEVICE WITH SPEED REGULATING MECHANISM

TECHNICAL FIELD

The patent relates to the technical field of winding devices, in particular to a winding device with a speed regulating mechanism.

BACKGROUND

A winding device is a device for winding a cable from a coil to a bobbin, and is commonly used in power engineering. Multiple winding devices of various models and sizes are configured according to different actual requirements, and a large winding device constructed in a mountain area is large in size, heavy in weight and difficult to carry. These winding devices are not smooth in a rotating process, and consequently, some structures need to be added to make the winding devices movable. The winding devices can evenly wind and unwind cables through guide elements during working, but the mobility of guide elements of existing winding devices is not high, which easily causes superposed winding after cables are gathered at a position of a coil, resulting in difficult subsequent winding, and affecting the unwinding process of the cables when in use. The existing winding devices are single in function, and has no locking function, and the transmission efficiency cannot be regulated.

SUMMARY

(1) Technical Problem to be Solved

The patent aims to provide a winding device with a speed regulating mechanism so as to solve the problem that the transmission efficiency cannot be regulated of a winding device in the prior art.

(2) Technical Solution

In order to solve the technical problems, the patent provides a winding device with a speed regulating mechanism, the winding device includes a device body and a winding wheel mounted on the device body, a speed regulating mechanism is arranged on one side of the winding wheel, the speed regulating mechanism includes a speed regulating transmission member and a sliding output gear which is in transmission connection with the speed regulating transmission member, and a speed regulating shifting rod is connected to and drives the sliding output gear to slide in an axial direction; the speed regulating transmission member is provided with a third regulating tooth and a fourth regulating tooth; in a normal state, the first regulating tooth is meshed with the third regulating tooth, which provides a first transmission rate, namely a first speed regulating gear position, of the speed regulating mechanism, the speed regulating shifting rod is shifted to move the sliding output gear and then the second regulating tooth is meshed with the fourth regulating tooth, which regulates to a second transmission rate, namely a second speed regulating gear position, of the speed regulating mechanism.

Further, a speed regulating box is mounted on one side of the winding wheel, the speed regulating mechanism is mounted in the speed regulating box, the upper end of the speed regulating shifting rod is placed outside the speed regulating box, two gear grooves are provided in the top end of the speed regulating box, a gear pin matched with the gear grooves is provided in the speed regulating shifting rod, when the transmission mechanism is located at a first gear position, the gear pin is placed in the first gear groove, and when the transmission mechanism is located at a second gear position, the gear pin is placed in the second gear groove.

Further, an idling mechanism is further arranged in the speed regulating box, the idling mechanism includes an output shaft, a lock catch plate and a handle, the sliding output gear is mounted on the output shaft, one end of the output shaft is connected to the winding wheel, the other end of the output shaft is connected to the handle, the winding wheel is provided with an annular gear ring, the gear ring is meshed with the gear on the output shaft, the lock catch plate is provided with a chute, the chute is divided into a locking groove in the upper end and a regulating groove in the lower end, the locking groove communicates with the regulating groove, an annular limiting portion is arranged on the output shaft, the diameter of the limiting portion is smaller than the width of the regulating groove and larger than the width of the locking groove, the lock catch plate is movably mounted on the speed regulating box through a positioning pin, when the limiting portion is located in the regulating groove, the output shaft may be pulled through the handle so that the output shaft is separated from the gear ring, at the moment, the output shaft idles, and the winding wheel will not be driven to rotate.

Further, the transmission gear set further includes an input gear, the input gear is meshed with the speed regulating transmission member, one side of the input gear is further connected to an input shaft, one end of the input shaft is connected to a water turbine, the water turbine is mounted on a side wall of the speed regulating box, and is a power source of the transmission gear set, the device body is provided with a transmission lead screw shaft, the winding wheel is in transmission connection with the transmission lead screw shaft through a chain wheel mechanism or a gear mechanism or a belt pulley mechanism, the transmission lead screw shaft is provided with a guide member capable of moving in a reciprocating manner in the axial direction of the transmission lead screw shaft, the transmission lead screw shaft is driven to rotate by the winding wheel to drive the guide member to move in the axial direction of the transmission lead screw shaft, and a cable can be uniformly wound on the winding wheel.

Further, the transmission lead screw shaft is provided with reciprocating threads, the reciprocating threads are divided into a first thread and a second thread that are opposite in direction so as to drive the guide member to move, and a clutch mechanism used for achieving the connection/disconnection of the transmission lead screw shaft and the guide member is arranged at the upper end of the guide member.

(3) Beneficial Effects

According to the winding device with a speed regulating mechanism in the patent, the winding wheel of the winding device can drive the transmission lead screw shaft to rotate during rotating, the guide member is movably provided through the clutch mechanism, and the transmission lead screw shaft can drive the guide member to move in an axial direction through the clutch mechanism, such that the cable can be uniformly wound on the winding wheel, which facilitates the unwinding of the cable when used subsequently. The speed regulating mechanism is mounted in the winding device, through the regulation of the speed regulating shifting rod, the transmission efficiency of the water turbine can be changed and the regulation of various winding speeds can be achieved. Moreover, an idling function can be fulfilled after the output shaft is pulled through the handle, which makes the winding wheel suspend moving. The winding device is complete in function and high in winding efficiency.

Figure 1:
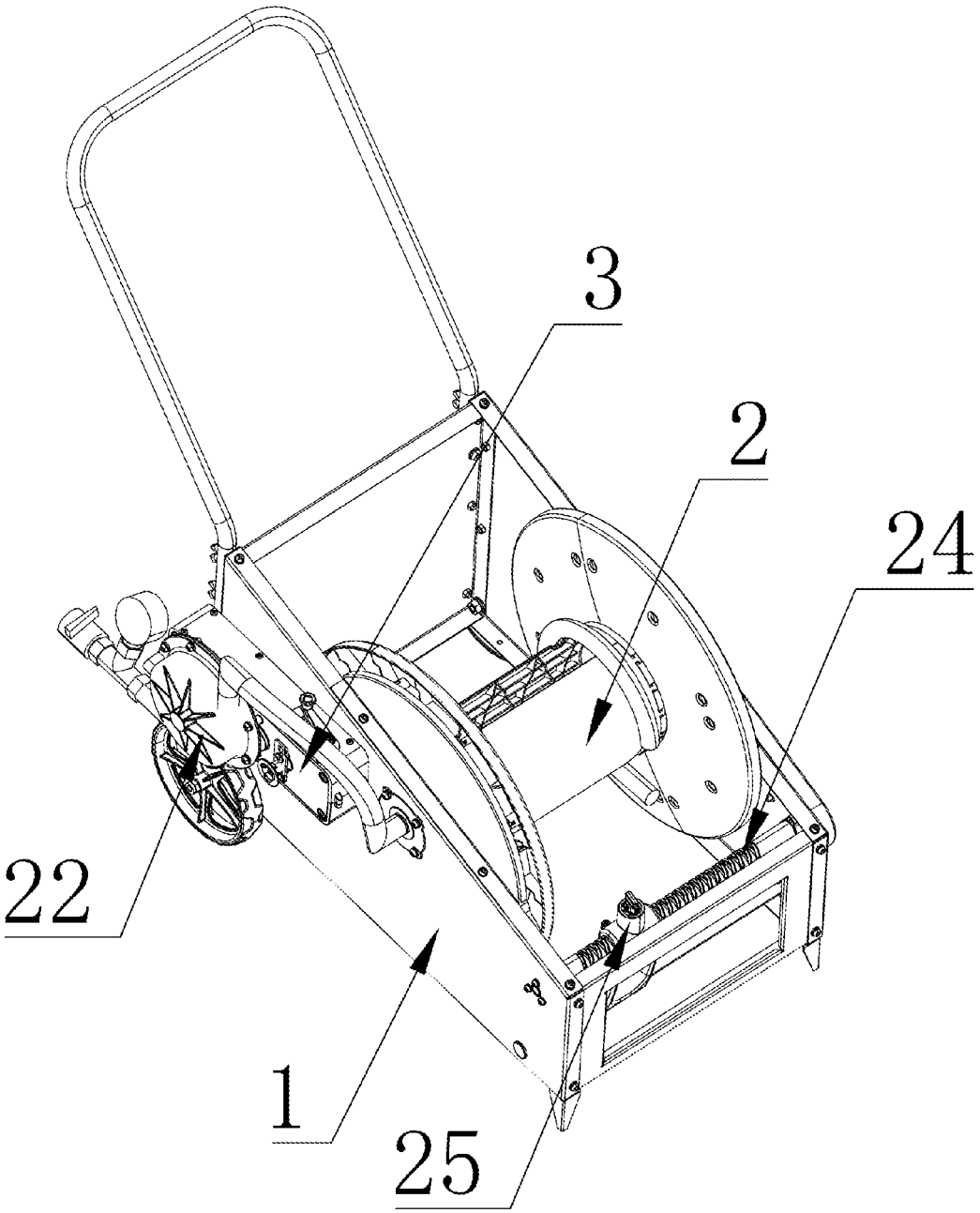
FIG. 1 is a three-dimensional view of a winding device with a speed regulating mechanism according to the patent.

1—device body, 2—winding wheel, 3—speed regulating box, 4—speed regulating shifting rod, 5—sliding output gear, 6—speed regulating transmission member, 7—first regulating tooth, 8—second regulating tooth, 9—third regulating tooth, 10—fourth regulating tooth, 11—gear groove, 12—gear pin, 13—output shaft, 14—lock catch plate, 15—handle, 16—locking groove, 17—regulating groove, 18—limiting portion, 19—positioning pin, 20—input gear, 21—input shaft, 22—water turbine, 23—gear ring, 24—transmission lead screw shaft, 25—guide member, 26—reciprocating thread, and 27—clutch mechanism.

DETAILED DESCRIPTION

Referring to FIG. 1 to FIG. 11, in order to solve the technical problems, the patent provides a winding device with a speed regulating mechanism, including a device body 1 and a winding wheel 2 mounted on the device body 1. The speed regulating mechanism is arranged on one side of the winding wheel 2, and includes a transmission gear set and a speed regulating shifting rod 4. The transmission gear set includes a speed regulating transmission member 6 and a sliding output gear 5 which is in transmission connection with the speed regulating transmission member 6, and the speed regulating shifting rod 4 is connected to and drives the sliding output gear 5 to slide in an axial direction. The speed regulating transmission member 6 is provided with a third regulating tooth 9 and a fourth regulating tooth 10. The speed regulating mechanism is correspondingly provided with a first speed regulating gear position and a second speed regulating gear position. In a normal state, the first regulating tooth 7 is meshed with the third regulating tooth 9. After the speed regulating shifting rod 4 is shifted to move the sliding output gear 5, the second regulating tooth 8 is meshed with the fourth regulating tooth 10. In this embodiment, because the bottom of the speed regulating shifting rod 4 is clamped at two ends of the sliding output gear 5, the sliding output gear 5 can be moved by shifting the speed regulating shifting rod 4, so as to realize the regulation of a transmission rate. Specifically, a speed regulating box 3 is mounted on one side of the winding wheel 2, the speed regulating mechanism is mounted in the speed regulating box 3, the upper end of the speed regulating shifting rod 4 is placed outside the speed regulating box 3. Two gear grooves 11 are provided in the top end of the speed regulating box 3. A gear pin 12 matched with the gear grooves 11 is arranged on the speed regulating shifting rod 4. After gear position adjustment, the gear pin 12 is placed in the gear groove 11. During adjustment, the speed regulating shifting rod 4 is lifted up to separate the gear pin 12 from the gear groove 11. After shifting, the gear pin enters the other gear groove 11, and thus, the speed regulation is completed.

Referring to FIG. 3 to FIG. 9, in this embodiment, an idling mechanism is further arranged in the speed regulating box 3. The idling mechanism includes an output shaft 13, a lock catch plate 14 and a handle 15. The sliding output gear 5 is mounted on the output shaft 13. One end of the output shaft 13 is connected to the winding wheel 2. The other end of the output shaft 13 is connected to the handle 15. The lock catch plate 14 is provided with a chute. The chute is divided into a locking groove 16 in the upper end and a regulating groove 17 in the lower end. The locking groove 16 communicates with the regulating groove 17. The output shaft 13 is provided with an annular limiting portion 18. The diameter of the limiting portion 18 is smaller than the width of the regulating groove 17 and larger than the width of the locking groove 16. The lock catch plate 14 is movably mounted on the speed regulating box 3 through a positioning pin 19, such that the position of the lock catch plate 14 can be adjusted up and down. The winding wheel 2 is provided with an annular gear ring 23. The gear ring 23 is meshed with a gear on the output shaft 13. In a locking state, the limiting portion 18 is placed in the locking groove 16. At the moment, the output shaft 13 cannot be pulled outwards by pulling the handle 15, such that the gear on the output shaft 13 cannot be separated from the gear ring 23. The lock catch plate 14 is pushed, when the limiting portion 18 is placed in the regulating groove 17, due to the fact that the width of the regulating groove 17 is larger than the diameter of the limiting portion 18, the output shaft 13 can be pulled outwards by a distance through the handle 15, such that the gear at an end of the output shaft 13 is separated from the gear ring 23. At the moment, the power of the output shaft 13 cannot drive the winding wheel 2 to rotate, and thus an idling state is achieved. At the moment, the winding wheel 2 can suspend running. In this embodiment, the transmission gear set further includes an input gear 20. The input gear 20 is meshed with the speed regulating transmission member 6. One side of the input gear 20 is further connected to an input shaft 21. One end of the input shaft 21 is connected to a water turbine 22. The water turbine 22 is mounted on a side wall of the speed regulating box 3. The water turbine 22 is a power source of this embodiment. The water turbine 22 drives the input shaft 21 and the input gear 20 to run, and in turn the whole transmission gear set is driven to run.

Figure 2:
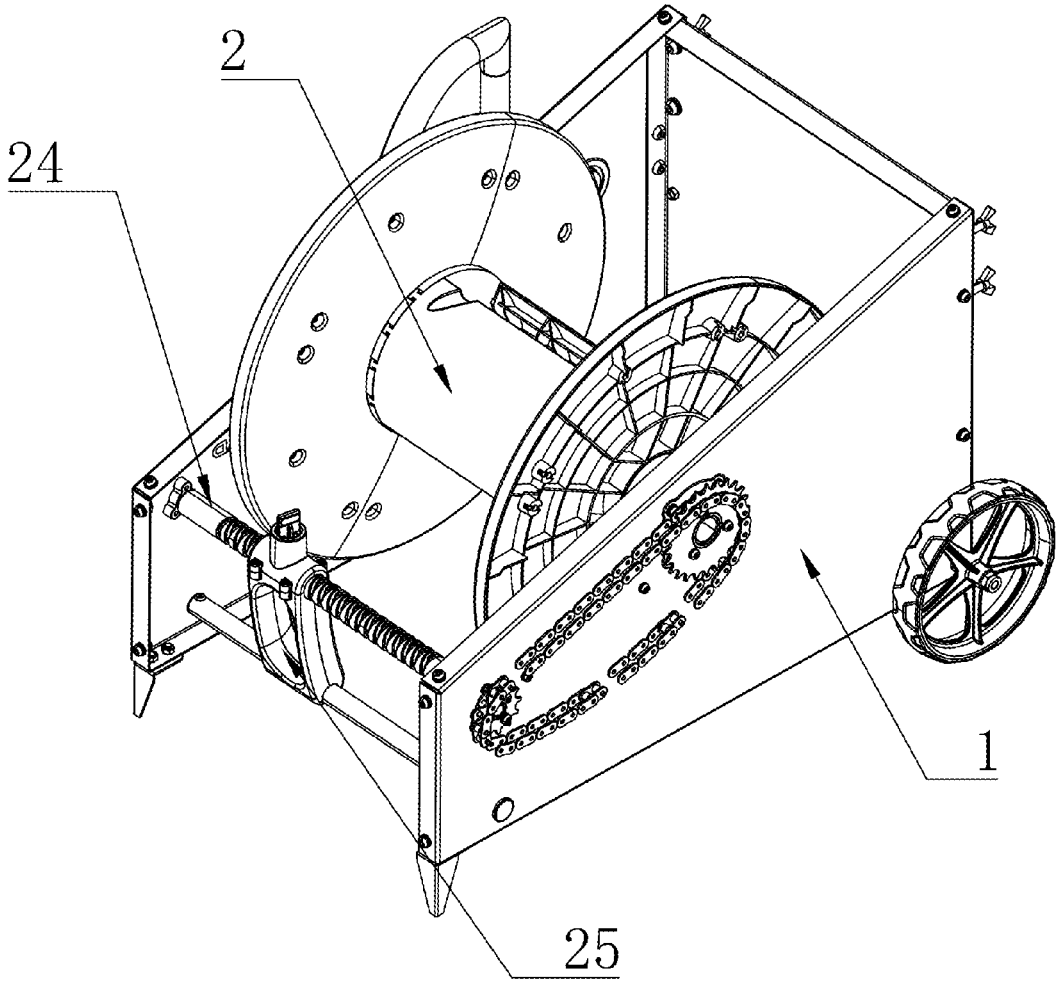
FIG. 2 is another three-dimensional view of the winding device with a speed regulating mechanism according to the patent.
Figure 3:
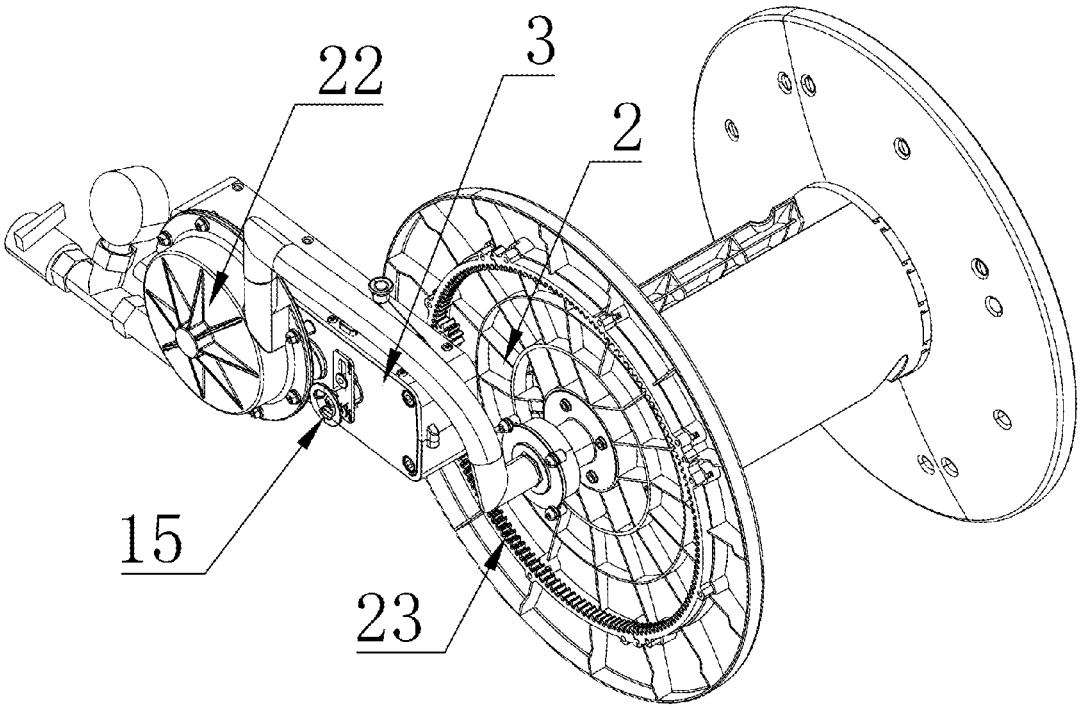
FIG. 3 is a three-dimensional view of a winding wheel and a reduction gearbox of the winding device with a speed regulating mechanism according to the patent.
Figure 4:
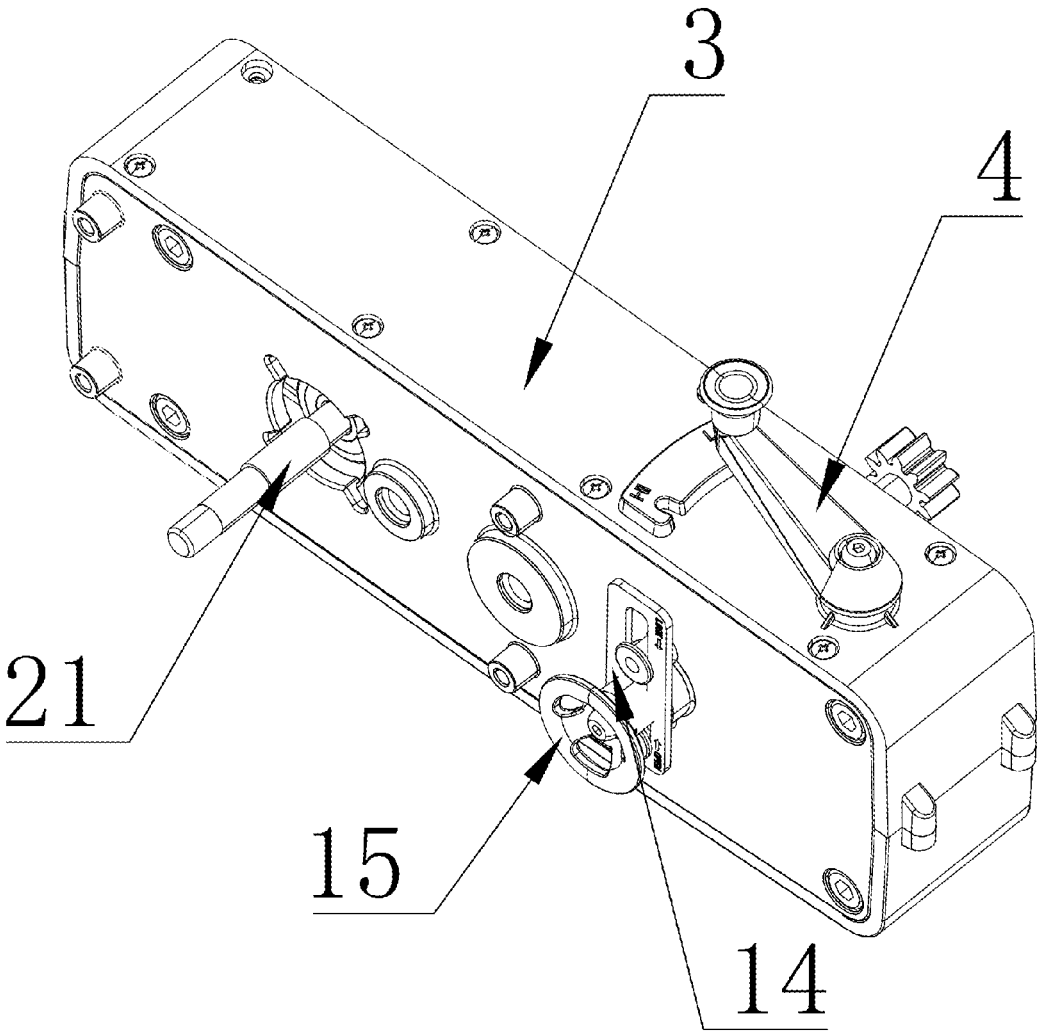
FIG. 4 is a three-dimensional view of the reduction gearbox of the winding device with a speed regulating mechanism according to the patent.
Figure 5:
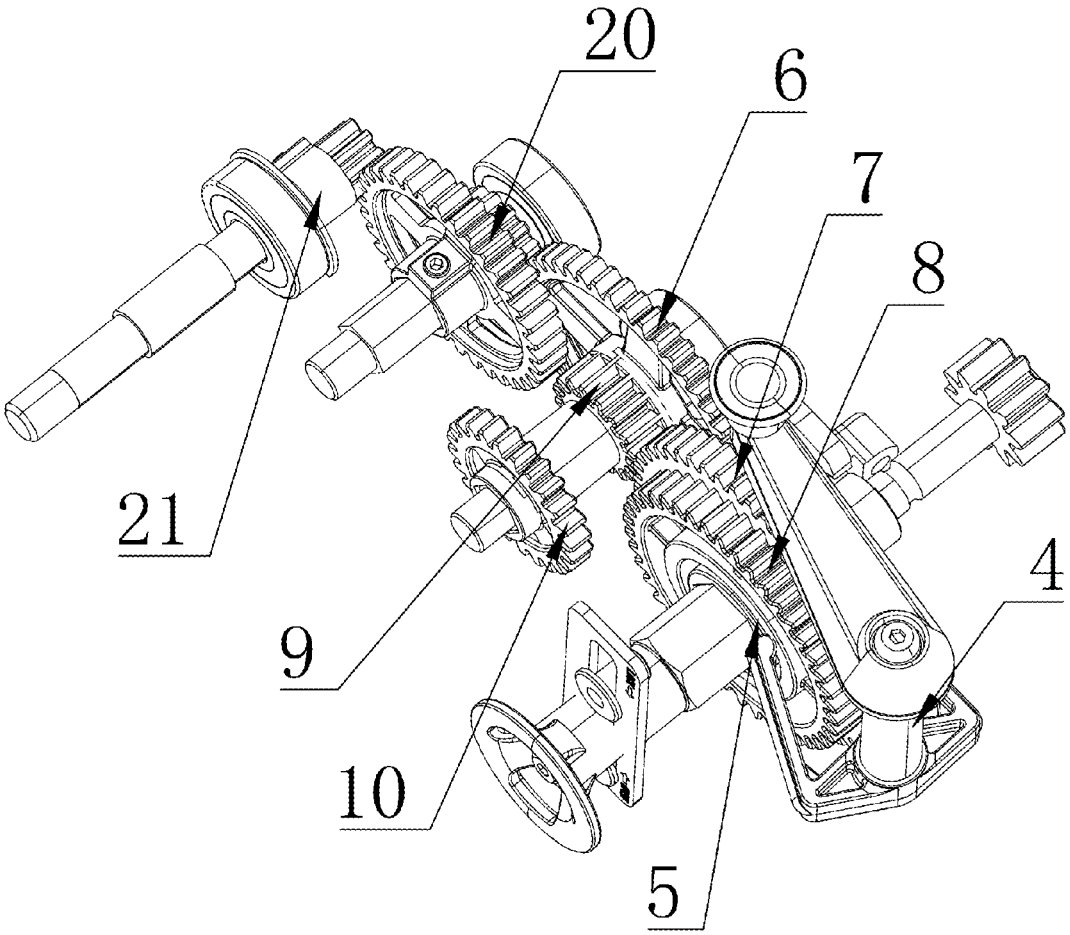
FIG. 5 is a three-dimensional view of an internal structure of the reduction gearbox of the winding device with a speed regulating mechanism according to the patent.
Figure 6:
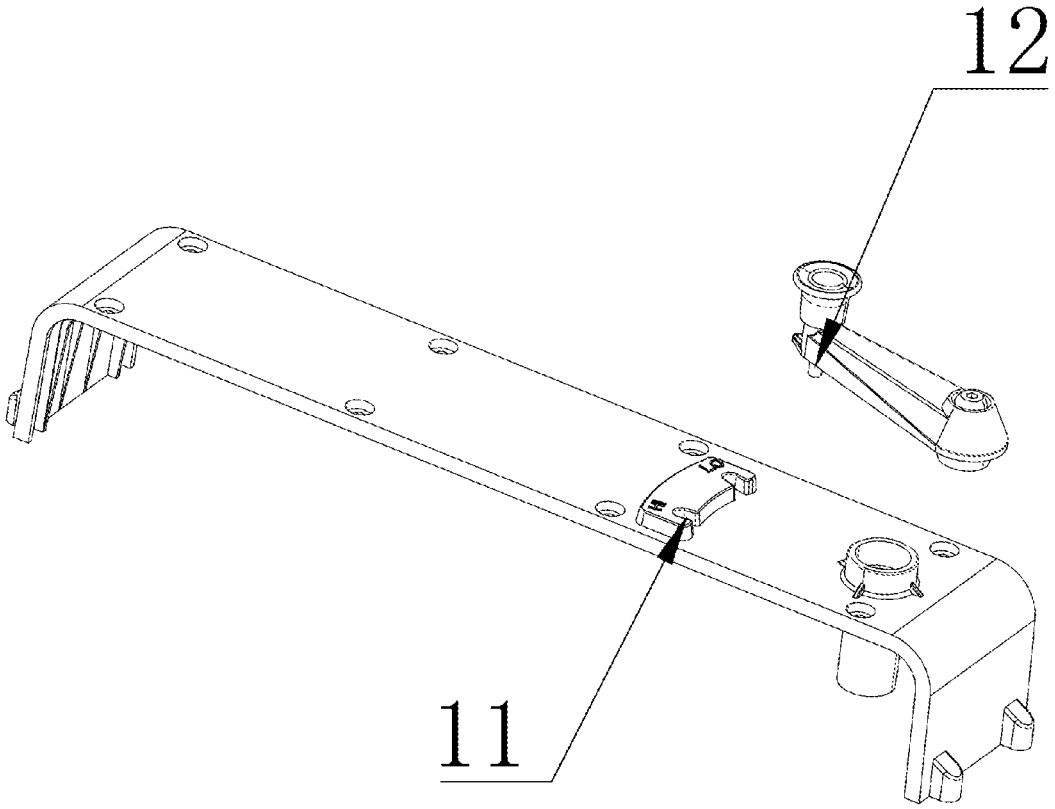
FIG. 6 is an exploded view of a speed regulating shifting rod and a reduction gearbox upper cover of the winding device with a speed regulating mechanism according to the patent.
Figure 7:
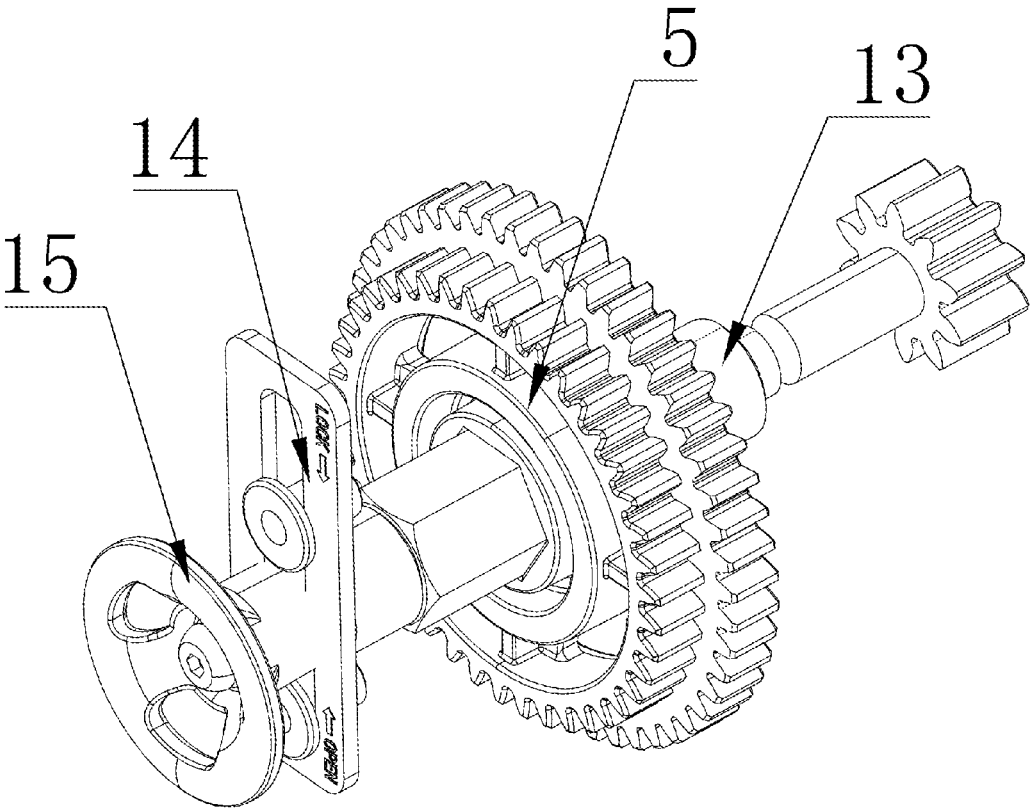
FIG. 7 is a three-dimensional view of an output shaft and a lock catch plate of the winding device with a speed regulating mechanism according to the patent.
Figure 8:
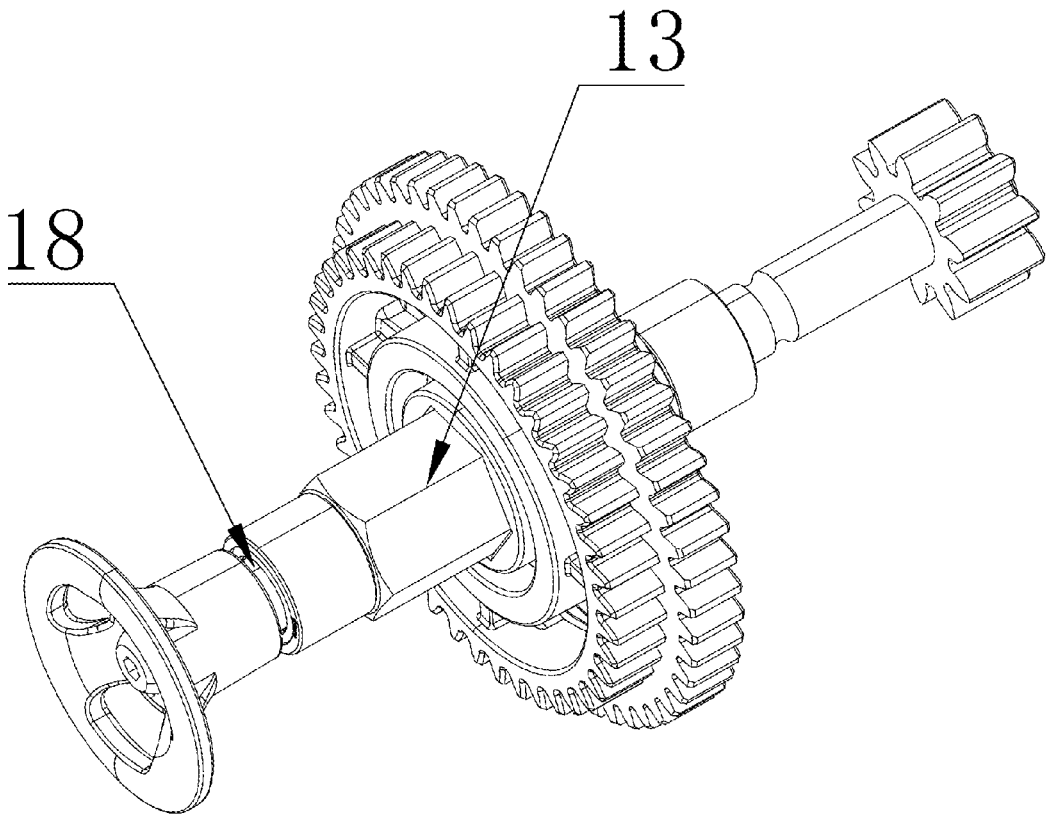
FIG. 8 is a three-dimensional view of the output shaft of the winding device with a speed regulating mechanism according to the patent.
Figure 9:
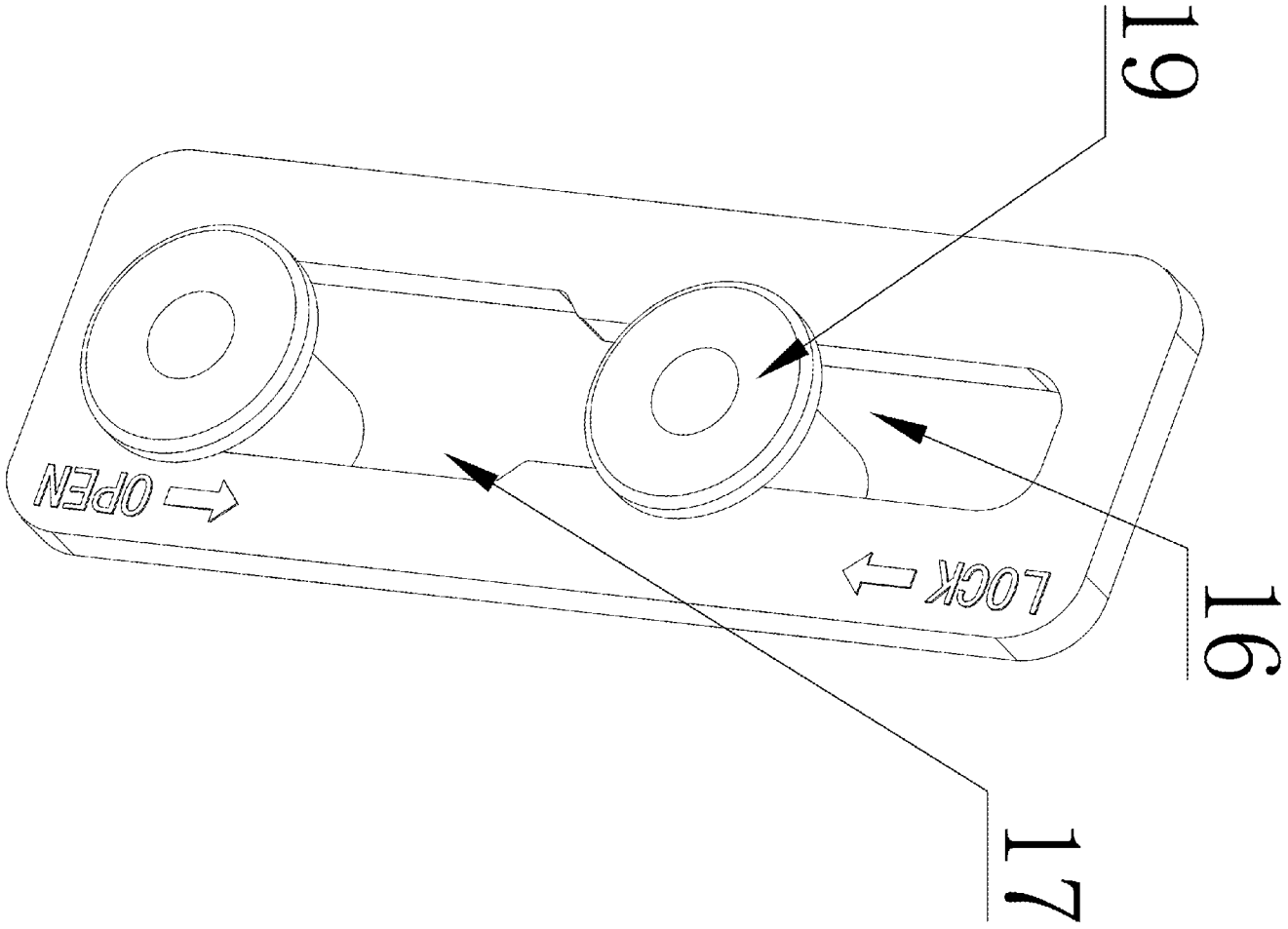
FIG. 9 is a three-dimensional view of the lock catch plate of the winding device with a speed regulating mechanism according to the patent.
Figure 10:
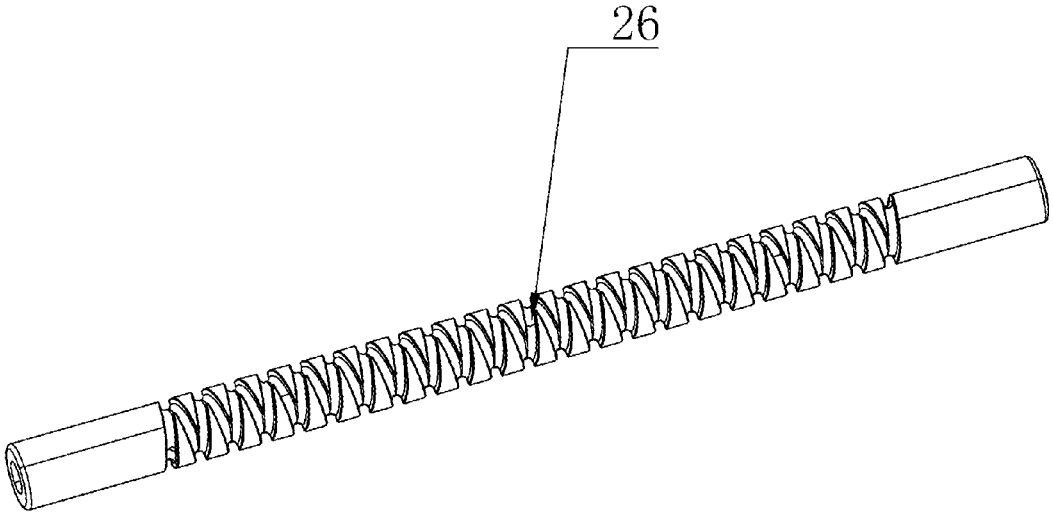
FIG. 10 is a three-dimensional view of a transmission lead screw shaft of the winding device with a speed regulating mechanism according to the patent.
Figure 11:
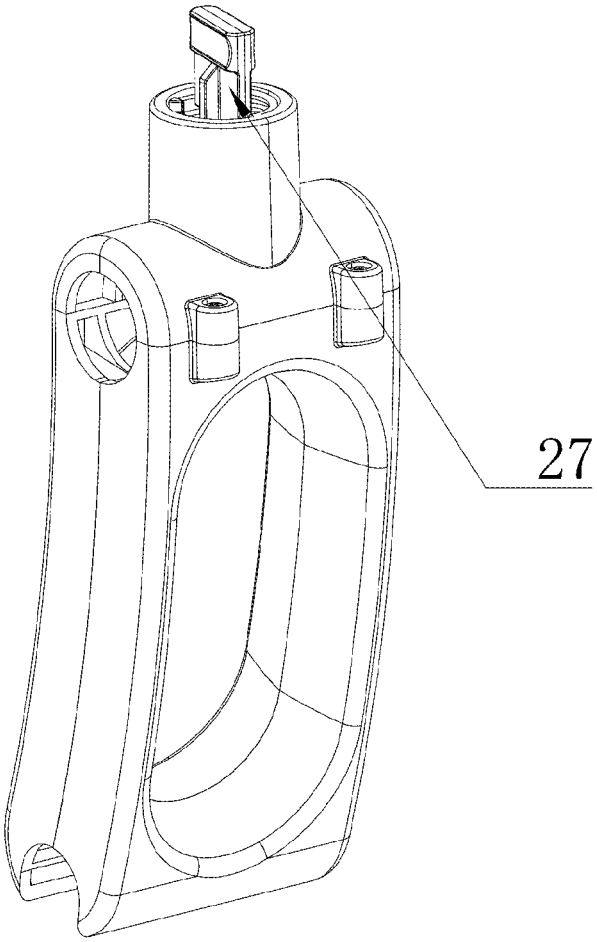
FIG. 11 is a three-dimensional view of a guide member of the winding device with a speed regulating mechanism according to the patent.

Referring to FIG. 2, FIG. 10 and FIG. 11, the device body 1 is provided with a transmission lead screw shaft 24. The winding wheel 2 is in transmission connection with the transmission lead screw shaft 24 through a chain wheel mechanism or a gear mechanism or a belt pulley mechanism. The transmission lead screw shaft 24 is provided with a guide member 25 capable of moving in a reciprocating manner in the axial direction of the transmission lead screw shaft. The transmission lead screw shaft 24 is provided with reciprocating threads 26. The reciprocating threads 26 are divided into a first thread and a second thread that are opposite in direction. A clutch mechanism 27 which is used for achieving the connection/disconnection of the transmission lead screw shaft 24 and the guide member 25 is arranged at the upper end of the guide member 25. The guide member 25 is provided with a wire guide hole. The guide member 25 drives a cable to move through the wire guide hole, to realize uniform winding. The reciprocating threads 26 are matched with the hole in the guide member 25. While the transmission lead screw shaft 24 rotates, the clutch mechanism 27 drives the guide member 25 to move up and down, and is driven by the reciprocating threads 26 to move in a reciprocating manner in an axial direction, so as to drive the guide member 25 to move in a reciprocating manner to achieve back-and-forth winding.

According to the winding device with a speed regulating mechanism in the patent, the winding wheel of the winding device can drive the transmission lead screw shaft to rotate during rotating, the guide member is movably provided through the clutch mechanism, and the transmission lead screw shaft can drive the guide member to move in an axial direction through the clutch mechanism, such that the cable can be uniformly wound on the winding wheel, which facilitates the unwinding of the cable when used subsequently. The speed regulating mechanism is mounted in the winding device, through the regulation of the speed regulating shifting rod, the transmission efficiency of the water turbine can be changed and the regulation of various winding speeds can be achieved. Moreover, an idling function can be fulfilled after the output shaft is pulled through the handle, which makes the winding wheel suspend moving. The winding device is complete in function and high in winding efficiency.

The foregoing is only a preferred embodiment of the patent, and it should be noted that, for those skilled in the art, a plurality of improvements and embellishments can be made without departing from the technical principle of the patent, and these improvements and embellishments should also be regarded as the protection scope of the patent.

What is claimed is:

1. A winding device with a speed regulating mechanism, comprising:

a device body; and a winding wheel installed on the device body, wherein the speed regulating mechanism is arranged on one side of the winding wheel, the speed regulating mechanism comprises:

a transmission gear set including a speed regulating transmission member and a sliding output gear which is in transmission connection with the speed regulating transmission member, the sliding output gear including a first regulating tooth and a second regulating tooth;

a speed regulating shifting rod, that is connected to and drives the sliding output gear to slide in an axial direction; and a speed regulating box mounted on one side of the winding wheel, the speed regulating mechanism being mounted in the speed regulating box, wherein an upper end of the speed regulating shifting rod is placed outside the speed regulating box, wherein two gear grooves are provided in a top end of the speed regulating box, and a gear pin matched with the gear grooves are arranged on the speed regulating shifting rod, wherein the speed regulating transmission member includes a third regulating tooth and a fourth regulating tooth, and the speed regulating mechanism includes a first speed regulating gear position and a second speed regulating gear position, and when the speed regulating shifting rod is shifted to the first speed regulating gear position, the sliding output gear is meshed with the third regulating tooth, and when the speed regulating shifting rod is shifted to the second speed regulating gear position, the sliding output gear slides in the axial direction and is meshed with the fourth regulating tooth.

2. The winding device with a speed regulating mechanism according to claim 1, wherein when the speed regulating mechanism is located at the first speed regulating gear position, the first regulating tooth is meshed with the third regulating tooth, and when the speed regulating mechanism is located at the second speed regulating gear position, the second regulating tooth corresponds to the fourth regulating tooth.

3. The winding device with a speed regulating mechanism according to claim 1, wherein an idling mechanism is further arranged in the speed regulating box, and comprises an output shaft, a lock catch plate and a handle, the sliding output gear is mounted on the output shaft, one end of the output shaft is connected to the winding wheel, and the other end of the output shaft is connected to the handle.

4. The winding device with a speed regulating mechanism according to claim 3, wherein a chute is provided in the lock catch plate, and is divided into a locking groove in the upper end and a regulating groove in the lower end, the locking groove communicates with the regulating groove, an annular limiting portion is arranged on the output shaft, the diameter of the limiting portion is smaller than the width of the regulating groove and larger than the width of the locking groove, and the lock catch plate is movably mounted on the speed regulating box through a positioning pin.

5. The winding device with a speed regulating mechanism according to claim 1, wherein the transmission gear set further comprises an input gear, the input gear is meshed with the speed regulating transmission member, one side of the input gear is further connected to an input shaft, one end of the input shaft is connected to a water turbine, and the water turbine is mounted on a side wall of the speed regulating box.

6. The winding device with a speed regulating mechanism according to claim 3, wherein an annular gear ring is arranged on the winding wheel, and the gear ring is meshed with a gear on the output shaft.

7. The winding device with a speed regulating mechanism according to claim 1, wherein a transmission lead screw shaft is mounted on the device body, and the winding wheel is in transmission connection with the transmission lead screw shaft through a chain wheel mechanism or a gear mechanism or a belt pulley mechanism.

8. The winding device with a speed regulating mechanism according to claim 7, wherein the transmission lead screw shaft is provided with a guide member capable of moving in a reciprocating manner in the axial direction of the transmission lead screw shaft.

9. The winding device with a speed regulating mechanism according to claim 8, wherein the transmission lead screw shaft is provided with reciprocating threads, the reciprocating threads are divided into a first thread and a second thread, which are opposite in direction; and a clutch mechanism which is used for achieving the connection/disconnection of the transmission lead screw shaft, the clutch mechanism being arranged at the upper end of the guide member.

* * * * *